US011280005B2

(12) United States Patent
Kaplunov

(10) Patent No.: US 11,280,005 B2
(45) Date of Patent: Mar. 22, 2022

(54) METHOD FOR PRODUCING RELIEF IMAGE ON A METAL BASE

(71) Applicant: Sergey Gennadievich Kaplunov, Sankt-Peterburg (RU)

(72) Inventor: Sergey Gennadievich Kaplunov, Sankt-Peterburg (RU)

( * ) Notice: Subject to any disclaimer, the term of this patent is extended or adjusted under 35 U.S.C. 154(b) by 0 days.

(21) Appl. No.: 17/283,720

(22) PCT Filed: Oct. 22, 2019

(86) PCT No.: PCT/RU2019/000757
§ 371 (c)(1),
(2) Date: Apr. 8, 2021

(87) PCT Pub. No.: WO2020/106176
PCT Pub. Date: May 28, 2020

(65) Prior Publication Data

US 2021/0324523 A1 Oct. 21, 2021

(30) Foreign Application Priority Data

Nov. 22, 2018 (RU) ..... RU2018141129

(51) Int. Cl.
*C23F 1/02* (2006.01)

(52) U.S. Cl.
CPC ..... *C23F 1/02* (2013.01)

(58) Field of Classification Search
None
See application file for complete search history.

(56) References Cited

U.S. PATENT DOCUMENTS 5,912,506 A * 6/1999 Colgan ..... H01L 23/538
257/750

OTHER PUBLICATIONS

Kim et al. "Corrosion Behavior and Metallization of Cu-Based Electrodes Using MoNi Alloy and Multilayer Structure for Back-Channel-Etched Oxide Thin-Film Transistor Circuit Integration", IEEE Transactions On Electron Devices, vol. 64, No. 2, Feb. 2017, p. 477 (Year: 2017).*

* cited by examiner

*Primary Examiner* — Allan W. Olsen
(74) *Attorney, Agent, or Firm* — Nadya Reingand; Yan Hankin

(57) ABSTRACT

The invention relates to producing a relief image on a metal base. The present method includes forming a resist pattern on a surface of a base and etching the sections of the metal which are not covered by the resist. In the present method, copper or an alloy thereof is deposited as a resist on a metal base having an electrode potential that is more negative than the electrode potential of copper, and etching is carried out in a solution that dissolves the parts not covered by the resist primarily as a result of a contact exchange reaction between the metal of the base and the copper ions. The invention makes it possible to improve the quality of the resulting image by means of reducing etchback of a metal base via pores of a resist, and to reduce the cost of producing products.

2 Claims, No Drawings

METHOD FOR PRODUCING RELIEF IMAGE ON A METAL BASE

FIELD OF THE INVENTION

The invention relates to a method for producing a relief image on a metal base.

BACKGROUND OF THE INVENTION

There are various methods of producing relief images on metals by deepening open areas in comparison with those protected areas by etching. The resists in the form of galvanic deposits of various metals and alloys and etching solutions, the composition of which is determined by the type of resist and base metal and the etching purpose, are widely used for their implementation [Ilyin V. A. Tekhnologiya izgotovleniya pechatnykh plat (*Technology of manufacturing printed circuit boards*). Leningrad: Mashinostroenie, 1984, page 37].

The closest to the proposed solution is a method for producing a relief image on steel, including the formation of a lead resist pattern on the steel surface and etching of metal sections, unprotected by the resist. [Inventor's Certificate of USSR No. SU77042, IPC 15b, 48d. A method for producing a relief image on steel. Vyrypaeva G. S., application No. 376333, filed on 24 Mar. 1948, published on 31 Oct. 1949, page 2].

However, it is known that with a more positive electrode potential in the metal resist than in the base metal, a galvanic couple is formed, in which the base is the anode, therefore, the absence of porosity in the protective coating is an indispensable condition for reliable protection. Through pores become the centers of corrosion as soon as the pickling solution enters them, as a result the products quality deteriorates. The need for poreless of the resist is a significant disadvantage of the method, since it requires an increased thickness of the coating and special conditions and equipment for its deposition, which limits the application of the method.

SUMMARY

The proposed method makes it possible to improve the quality of the processed products by reducing the likelihood of through etching of the base metal through the pores of the resist, to reduce the porosity requirement for metal resists and, in some cases, to abandon the application of resistive coatings by a laborious and costly galvanic method and apply a relatively simple process of immersion deposition.

The technical result is achieved by the fact that in the method for producing a relief image on a metal base, including the formation of a resist pattern on the surface of the base and etching of metal sections unprotected by the resist, for a metal base having an electrode potential that is more negative than the electrode potential of copper, copper or an alloy thereof is deposited as a resist, and the etching is carried out in a solution that ensures the dissolution of the sections unprotected by the resist primarily as a result of a contact exchange reaction between of the base metal and the copper ions.

In this case, when the etching solution interacts with the surface to be treated, two processes proceed in parallel—contact exchange between the base metal and copper ions and electrolysis due to the operation of the formed short-circuited galvanic metal-resist couple, in which the base is the anode. It follows from the electrode reactions that as a result of the anodic dissolution of the base metal, a deep relief is formed, and as a result of cathodic reduction, copper is released on unprotected sections of the base and copper is deposited on the resist surface. At the same time, in open sections, a porous coating with a highly developed surface is formed, which practically does not have adhesion to the base, and on the resist, copper settles in a compact form, increasing its thickness. With an increase in the copper thickness, the number of pores reaching the base metal decreases, and at certain thicknesses the resist becomes practically poreless. A qualitative result can be obtained when the pore overgrowth occurs faster than the etching of the base metal under the pores of the resist. Such an etching regime is possible due to the unequal flow of cathodic and anodic reactions in the pores and in open sections of the metal.

The rate of contact exchange in open sections of the base is determined by the rate of the cathodic conjugate reaction of copper reduction, which is proportional to the concentration of copper ions in the solution. The parallel flow of internal electrolysis increases the rate of anodic dissolution and it becomes equal to the sum of the rates of both cathodic reactions. The current of the cathodic reaction of the contact exchange process is significantly higher than the cathodic current of the galvanic resist-metal couple; accordingly, the concentration polarization in the open sections of the metal is significantly higher; under these conditions, the current is redistributed in favor of the resist. In the absence of concentration limitations of the cathodic process, the rate of anodic dissolution under the pores of the resist does not depend on the concentration of the metal being reduced, since it is controlled by the diffusion of corrosion products through the pores, and the anode current is directly proportional to the pore area in the resist. Due to the slow removal, the concentration of dissolved metal ions in the pores rapidly increases up to saturation, which leads to the suspension of the destruction of the base and the copper deposited on the resist surface seals the pores. In the light of the foregoing, the decisive factors determining the possibility of pore overgrowing are the porosity value of the copper coating, which depends on its thickness and production method, and the concentration of copper ions in the solution.

It has been experimentally established that the copper protective layer must have a minimum thickness of 1-1.5 μm. Smaller values of thickness, due to multiple porosity, can lead to the merger of local destructions under the pores of the resist and etching of the base metal.

The lower limit of the concentrations of copper ions must provide that a continuous compact copper layer of sufficient thickness is obtained on the surface of the resist and an acceptable etching rate. The concentration can be increased up to the limit at which compact copper is deposited on the resist and no over-etching of the base metal occurs. Experiments have shown that the highest quality results are obtained in solutions containing copper salt 30-100 g/l in terms of metal. When the copper salt content is less than 30 g/l, the process proceeds with cathodic diffusion control, the rates of etching of the base metal and copper reduction are low, and the conditions necessary for overgrowing the pores are not provided. At a concentration of more than 100 g/l, there is a tendency of the base to over-etching and the formation of large-crystalline copper deposits.

The distribution of the cathodic current in different parts of the resist surface is not the same and depends on the geometry of the processed relief and the covering power of the etching solution. The current will be higher in those areas that form a galvanic couple with a minimum internal resistance, that is, at the resist-metal interface and decreases with distance from it. With distance, the current density does not change linearly, since it is determined not only by the resistance of the solution, but also by the polarization. Due to uneven current distribution at a distance from the edge of the resist, the current density may turn out to be less than the minimum required and part of the surface will remain uncoated with copper or its thickness will be insufficient for overgrowing the pores. To prevent etching of the base metal, such areas must be covered with a chemically resistant material. It is known that the covering power of solutions depends significantly on their composition. In pickling solutions based on a copper salt of an inorganic acid, copper reduction occurs at low cathodic polarization and reliable pore closure is ensured at a distance of up to 2-3 mm from the relief boundary, when using a complex copper salt, the covering power of solutions increases—up to 50 mm or more. The electric fields of individual galvanic couples, formed by various relief elements, are superimposed on each other, locally increasing the current density and, accordingly, the thickness of the growing copper. Therefore, the shape and number of areas that are subject to retouching, and the need for retouching in general, will be determined not only by the composition of the etching solution, but also by the size, density and geometry of the processed relief.

In one embodiment of the invention, the etching is interrupted as soon as the contact copper is deposited in open sections. At the same time, contact copper is simultaneously allocated in the places of existing hidden resist defects, clearly revealing them, which helps to make retouching with chemically resistant material and avoid further etching of the base. This technique can be carried out once or periodically, in several successive stages with intermediate retouching of defects.

In another embodiment of the invention, after the contact exchange etching, the etching of the base metal is additionally performed in a solution that does not etch copper. Such a method can be expedient in the case when the etching must be carried out to a depth exceeding that at which a copper layer grows on the resist surface as a result of etching by contact exchange, ensuring its poreless (usually 5-6 μm is sufficient). This allows the use of cheaper etching solutions or those having a higher speed or better etching quality.

As a resist, you can use not only copper, but also its alloys, for example, with tin (15-20%). Such a coating has a stronger adhesion to the base metal and, with the same thickness, fewer pores.

The method can be used to obtain a relief image on substrates made of steel, zinc, aluminum and various alloys.

DETAILED DESCRIPTION OF THE PREFERRED EMBODIMENTS OF THE INVENTION

Example 1. On a prepared plate made of thin sheet of cold-rolled steel of (Russian steel) grade 08KP (08 КП), a resist pattern is formed by contact deposition of copper with a thickness of 3-4 μm. Copper plating solution composition: $CuS0_4.5H_20$—8-10 g/l, $H_2S0_4$ (specific gravity 1.84 g/cm3)—80-100 g/l, OP-10 (ОП-10, Russian surfactant)—8-10 g/l. Solution temperature is 30-35° C. Copper plating duration is 3 min. The areas equidistant from the edge of the resist at a distance of more than 2-2.5 mm are retouched with a chemically resistant varnish. Then the plate is subjected to etching in a solution containing $CuCl_2$—175-180 g/l at a temperature of 18-25° C. until a relief of the required depth is obtained. For 10 min, the average etching rate was 10 μm/min. The surface of the resist is covered with compact copper, the average deposition rate of copper at a distance from the edge of the relief 1.5-2 mm is about 0.8-1.2 μm/min. The results obtained show that it is of the same order of magnitude as the rate of copper release in conventional galvanic copper plating from sulfate electrolyte at a current density of 4-5 $A/dm^2$ . Consequently, under conditions of parallel flow of cathodic reactions of contact exchange and internal electrolysis, the current is redistributed in favor of the resist surface. After etching, the sample is washed in water, the varnish is removed with a solvent, and copper is removed in a solution that does not allow etching of the base metal, washed again and dried. Steel without pores, the contour of the relief is clear.

Example 2. The metal of the plate and the technological sequence of manufacturing is the same as in example 1, but instead of copper, an alloy of copper with tin with a thickness of 3-4 μm is deposited, the content of tin is 14-16%. Solution composition: $CuS0_4.5H_20$—8-10 g/l, $H_2SO_4$ (specific gravity 1.84 g/cm3)—80-100 g/l, $SnSO_4$—3-5 g/l, OP-10—3-5 g/l. Solution temperature is 30-35° C. Copper plating duration is 5 min. Steel pickling is carried out in a solution: $CuCl_2$—175-180 g/l and NaCl—100-120 g/l, at a temperature of 18-25° C. Steel without pores, the contour of the relief is clear.

Example 3. The metal of the plate and the technological sequence of manufacturing are the same as in example 1, but after etching by contact exchange for 5-6 min to a depth of about 0.05 mm, etching is stopped, the workpiece is washed in water and additional etching is carried out in a solution that etches the base metal and does not etch copper: $H_2C_2O_4.2H_2O$—160-180 g/l, $H_2O_2$ (30%)—130-150 ml/l, at a solution temperature of 30-35° C., to a relief depth of 0.3 mm. Steel without pores, the contour of the relief is clear.

In accordance with the invention, it has been found that it is possible to combine the etching of a metal base having an electrode potential that is more negative than the electrode potential of copper with the simultaneous deposition of copper on the resist of copper or its alloy, and thus exclude the etching of the base metal under the pores of the resist. This circumstance makes it possible to improve the quality of the processed products in comparison with the existing methods of obtaining a relief and to use a simple and no capital expenditure required immersion method for the deposition of copper or its alloys to create a protective coating on workpieces of various complexity and dimensions.

What is claimed is:

1. A method for producing a relief image on a metal base, including a formation of a resist pattern on surface of the metal base and an etching of metal sections, unprotected by the resist pattern, having for the metal base an electrode potential that is more negative than an electrode potential of copper, or copper alloy that is deposited as a resist, and the etching is carried out in a solution containing at least a copper salt of not more than 100 g/l in terms of metal that ensures a dissolution of the metal sections unprotected by the resist primarily as a result of a contact exchange reaction between the metal base and copper ions.

2. A method according to claim 1, wherein areas of the resist that are located more than 2 mm from a resist edge are covered with a chemically resistant material before etching.

* * * * *